United States Patent [19]

Michaels-Christopher

[11] 4,110,082

[45] Aug. 29, 1978

[54] REFORMED HYDROCARBONS AND ALCOHOLS FROM FUEL ALLOYS AND REFORMING AGENTS

[76] Inventor: Van Michaels-Christopher, 1817½ N. Las Palmas Ave., Hollywood, Calif. 90028

[21] Appl. No.: 764,283

[22] Filed: Jan. 31, 1977

Related U.S. Application Data

[63] Continuation-in-part of Ser. No. 552,802, Feb. 25, 1975, abandoned, Continuation-in-part of Ser. No. 655,275, Feb. 4, 1976, abandoned, Continuation-in-part of Ser. No. 735,110, Oct. 22, 1976, Continuation-in-part of Ser. No. 445,792, Feb. 25, 1974, abandoned.

[51] Int. Cl.[2] ..... C10L 1/10

[52] U.S. Cl. ..... 44/50; 44/52; 44/80; 48/197 R; 423/439

[58] Field of Search ..... 423/439; 44/50, 52; 48/197 R; 552/802

[56] References Cited

U.S. PATENT DOCUMENTS

| | | | |
|---|---|---|---|
| 2,686,819 | 8/1954 | Johnson | 423/439 UX |
| 3,031,287 | 4/1962 | Benson et al. | 423/439 X |

OTHER PUBLICATIONS

J. A. Mathews, "Review & Bibliography of the Metallic Carbides," Smithsonian Misc. Collections, 1898 pp. 15–19, 28.

Chem. Abs. H. Koritke et al. 11677 c.

Treatise on Inorganic Chem. vol. 1, Remy 1956, pp. 466, 467.

Advanced Inorganic Chem. Cotton et al. 1967, pp. 301–304.

Carbides in Nuclear Energy vol. 1, TK 9350 S9 1963, pp. 273–279, Besson et al.

*Primary Examiner*—Allen B. Curtis

[57] ABSTRACT

This invention relates to the manufacturing of quality engine fuels (hydrocarbons and alcohols) from my hydrogenating fuel alloys and reforming agents.

4 Claims, No Drawings

REFORMED HYDROCARBONS AND ALCOHOLS FROM FUEL ALLOYS AND REFORMING AGENTS

This invention is a continuation in part and major improvement of my earlier U.S. Patent pending inventions: Ser. No. 552,802 filed on 2/25/75, titled "Isothermic Synthetic and Natural Fuels"; Ser. No. 655,275 filed on Feb. 4, 1976 titled: "Synthetic and Non-Synthetic Cracking Isothermic Fuels", both now abandoned; Ser. No: 735,110 filed on Oct. 22, 1976, titled: "Hydrogenating Fuel Alloys"; Ser. No: 445,792 filed on Feb. 25, 1974 titled: "New Fuels and New Fuel Manufacturing Process"; (now abandoned).

The beauty of my process is that it needs no hydrogen nor synthesis gas to prepare the needed hydrocarbons and alcohols. Thus my reformed engine fuels represent an inexhaustable new source of energy which when developed will become as important as is now the natural crude oil. That is because the process uses as feed stock only water and carbonaceous materials mixed with limited quantities only of other materials which are continuously recycled during the manufacturing. The main object of the invention is to prepare reformed cracking isothermic fuels from quenched and recyclicable hydrogenating fuel alloys evolving hydrocarbons through hydrolysis agregate (associate) reforming agents and alcohols to obtain advanced fuels possessing cooling and lubricating properties high octane number and less pollutants.

The second object of the invention is to find effective reforming agents to do the reforming inexpensively and effectively both with my hydrocarbons and hydrocarbons derived from natural crude oil.

Other objects and advantages of the invention will be apparent to those skilled in the art upon reading the specification.

My reformed engine fuels are obtained as follows:

During my years of research and development in the area of synthetic hydrocarbons, I found that one can prepare excellent quenched Iron-Manganese-Carbon-Catalyst fuel alloys containing or not containing uranium sesquicarbide $U_2C_3$ that can evolve predominantly liquid engine hydrocarbons when submitted to hydrolysis and acidolysis (acid hydrolysis). I have also found that the above obtained hydrocarbons can be further improved through the abovementioned special reforming agents. The above quenched fuel alloys hydrogenating the carbon can be obtained as follows: Initially into a chemical reactor are poured a powdered mixture of manganese and iron halides, oxides and hydroxides mixed with powdered carbon from coal or other carbonaceous materials as charcoal and refining wastes from crude oil. Because the halides are self-catalyzing the formation of the fuel alloys the Iron and the Manganese halides mixed with carbon are the preferred feed stock and the preferred halide is the Iron (III) Chloride ($FeCl_3$) because it sublimates and volatilizes only at 300° C. and boils at about 310° C. which allows the manufacturing process of the fuel alloys to proceed quicker in complete gaseous state because the hot halide Iron steam is very active. Iron (II) Chloride ($FeCl_2$) is, however, also suitable feed stock because when heated it converts to Iron (III) Chloride and powdered fluidized Iron (III) oxide and because the powdered fluidizing state again permits fast synthesizing reactions between the carbon and the metals producing powdered hydrocarbonides (liquid and gaseous hydrocarbons evolving carbides not containing acetylene). The term hydrocarbonides is a generalization of the methanides (methane evolving carbides as they are the pure Manganese and other carbides) and the acetylides (acetylene evolving carbides as they are the alkali, alkali earth and many other popular metal carbides). As methane and acetylene are gaseous hydrocarbons, then in the case of my special fuel alloys evolving predominantly liquid hydrocarbons not involving acetylenes, the term hydrocarbinides is more accurate, proper and precise. Thus it is used throughout this invention instead of the common nonspecific word "carbides" comprising such diamond-like tool making carbides not specific to this invention for they do not evolve hydrocarbons at all and the acetylides deteriorating the fuels by causing detonations inside the engine and scalings as a result of the acetylene's decomposition.

When to the above hydrogenating fuel alloys is added uranium sesquicarbide to promote cold hydrolysis, the uranium sesquicarbide $U_2C_3$ must be synthesized separately for reasons that will become clear later. The pure manganese carbides evolve in hydrolyzed methane and hydrogen, however, I found that when it is alloyed with Iron hydrocarbonide especially with the cementite it promotes the evolving of liquid hydrocarbons in hot hydrolyse and in cold and hot diluted acidolyzes (acid hydrolyse). I also found that liquid hydrocarbons can be obtained from pure Iron hydrocarbonides, however, the yield of such manufacturing is low and if they are to be liberated, one must use very hot acidolysis performed with concentrated corrosive acids. During my research it appeared that all these and other inconveniences could be avoided if one uses hydrogenating fuel alloys, instead of my pure hydrocarbonides. The above powdered feed stock mixture is fluidized and partially evaporized to halide steam by passing through the bottom of the reactor limited quantities of air to cause incomplete buring and produce CO gas which fluidizes and heats the powdered mixture. When the temperature inside the reactor attains 500° C. to 1000° C. the CO gas attack the feed stock at atmospheric pressure and starts converting it catalytically into hydrocarbonide alloy.

At the above temperatures the $FeCl_3$ is entirely converted to very hot steam kind self catalyzing and catalyzing halide, catalyzing the contained powdered oxides, reducing and converting them as well as the $FeCl_3$ to mutually alloyed hydrocarbonides. The reaction is very fast for it occurs in a mixed gaseous and fluidized bed. The same reaction can be additionally speeded if some hydrogen and inert $CO_2$ gases are introduced to lower the partial pressure of CO below the atmospheric pressure. The needed low partial pressure of CO indicates that my process does not need synthesis gas because it is too rich on CO. When the synthesis of the hydrocarbonides mixture is completed the obtained powdered hot hydrocarbonides-carbon alloy is quickly passed into a cooling oil bed to be quenched at room temperature. The reason for the quenching process follows: As my experience has shown, the best yields of liquid hydrocarbons are obtained during the hydrolysis of the fuel alloy when the Iron hydrocarbonide consists entirely of cementite $Fe_3C$, known as $\delta$ phase of the Iron Carbide and $Mn_3C$ (known as manganese trita carbide). The cementite however cannot be obtained directly especially at the above prohibitive temperatures. In the temperature range of 500° C. to 1000° C. a great deal of other Iron and Manganese hydrocarbonides are formed but no one is cementite. At the above conditions the Iron hydrocarbonide fraction consists mainly of $Fe_2C$ and $Fe_4C$. At all temperatures higher than 420° C. the obtained $Fe_2C$ is always the $\chi$ phase of the iron hydrocarbonide known as Hagg carbide more accurately described by the formula $Fe_{20}C_9$ instead of the formula $Fe_2C$. Below 420° C. the obtained Hagg carbide begins a fairly slow conversion into its stable hexagonal phase known as $\epsilon$ phase of the Iron carbide and that self conversion continues down to 290° C. However in the temperature range of 290° C. to 380° C. that conversion is slow. On the other hand the obtained hexagonal $\epsilon$ phase is of very poor yield of hydrocarbons. The needed $\delta$ phase (the cementite) to obtain increased yields is obtained only if the temperature of conversion is rapidly lowered down to 55° C. or less, below room temperature. This conversion is another self conversion, which however needs very quick temperature lowering. Otherwise, the obtained hydrocarbonides convert themselves not into cementite, but into the stable $\epsilon$ phase, and into other carbides allowing very poor yield of hydrocarbons during the hydrolysis that must follow to liberate the liquid and gaseous hydrocarbons. On the other hand once the $\epsilon$ phase is obtained slowing or fast cooling do not convert the $\epsilon$ phase into cementite but into the original metal and graphite which significantly reduces the yield of the obtainable hydrocarbons. Hence for best yields, the quenching must not proceed in slow cooling air. If storage of the hydrocarbonides containing powdered alloy is not intended the quenching of the alloy can proceed in water. In such a case, the quenching process is unified with the hydrolysis, and when the fuel alloy is alloyed (before its quenching) with uranium sesquicarbide $U_2C_3$ that must be done at temperature above 420° C. to avoid the deterious $\epsilon$ phase. Stored unquenched fuel alloy must be preheated at above 420° C. and then quickly quenched before hydrolysis, otherwise the yield will be low. In addition to the above, it must be kept in mind that quenching is best obtained in oil not in water because when done in water, a part (sometime a large part) of the iron hydrocarbonides in the alloy are partially hydrolyzed before being converted to cementite which again reduces the yield. That is particularly true when the unified quenching-hydrolyzing process is acidic and strongly acidic. On the other hand as my experience has shown, the hydrolysis in non-acidic cold water of the obtained powdered hydrocarbonide alloy can be obtained only when the $Mn_3C$ content in the alloy is more than 75 percent. Consequently to avoid partial low yield hydrolysis during the obtaining of the cementite quenching in cold water (not acidic) could be practiced efficiently only when the $Mn_3C$ content of the alloy is below 75 percent. For a good yield and to proceed faster, the hydrolysis must be acidic and hot (hot acidolysis) whenever the content of the $Mn_3C$ of the fuel alloy is between 50 percent and 80 percent and the temperature near to the boiling temperature ranging from 85° C. to 95° C. Boiling temperatures is better avoided to avoid unnecessary water steam and reduce the necessary processing energy. When the $Mn_3C$ is 90 percent or more, the hydrolysis of the alloy is sufficiently fast in pure hot water. When the $Mn_3C$ is lowered down to 25 percent or less, good yield is possible only in boiling concentrated acids often corrosive to the factory equipment. $Fe_3C$ is resistant to cold concentrated acids. If to a fuel alloy (of the above type) containing up to 85 percent $Mn_3C$, is added 3 percent to 5 percent Si (as inhibitor of the cold water hydrolysis) then such high contending $Mn_3C$ alloy can be quenched in cold water. Repeated quenching increases the yield of the obtained cementite. Non-corrosive diluted hydrochloric acid during the hydrolysis is always desirable because the HCl helps in the meantime the recycling of the Iron into the needed Iron halides which are a must as catalysts and self catalysts to the hydrocarbonide synthesis. The hydrolysis supplies directly the process with the needed hydrogen thus avoiding the costly hydrogen plant which otherwise is a must. To further increase the yield of the obtained hydrocarbons and for better utilization of the hydrogen evolved together with the gaseous and liquid hydrocarbons during the hydrolysis of the obtained powdered hydrocarbonide alloys hydrogenation catalysts as chromium oxide and molybdenum oxide must be added. When the hydrolysis of the fuel alloy intended to produce light liquid hydrocarbons the catalyst must be chromium oxide. When the desired hydrocarbons are heavier, the catalyst must be molybdenum oxide and finally if one desires predominantly gaseous hydrocarbons the catalysts nickel and cobalt must be used. In each of these three cases for best hydrogenating effect high pressure, hot hydrolyses in the range of 200 to 300 atmospheres of pressure and temperature in the range of 200° C. to 400° C. must be employed. In these conditions the liberated nascent hydrogen liberated during the hydrolysis attacks the carbon constituent of the fuel alloy hydrogenating it to additional quality engine hydrocarbons in accordance of the employed catalyst and desire.

The above needed high pressure is self generating and its values can be easily controlled through a small injection pump injecting controlled portions of water (or diluted acid) to support the hydrolysis and through the temperature. The above described feed stock can be modified to produce from it hydrocarbons by direct hydrogenation avoiding the fuel alloy step. For this reason the manganese constituent of the feed stock is increased at least to 44 percent the carbons constiuent to another 44 percent and the rest of 12 percent must be reserved to the iron halide and the chromium molybdenum and cobalt catalyst. In addition to the above the manganese constituent must consist entirely of manganese dioxide ($MnO_2$). My modified direct hydrogenation performed with the above feed stock works as follows: the feed stock is poured and sealed into a chemical reactor and the reactor is heated to more than 530° C. up to 700° to 800° C. in the absence of air. As a result the manganese dioxide ($MnO_2$) is converted to $Mn_2O_3$ slowly liberating nascent oxygen. The oxygen ignites the carbon and partially converts it to carbon monoxide (CO). When all $MnO_2$ is converted to $Mn_2O_3$ and the pressure of the obtained CO gas attains at least 150 atmospheres the temperature of the reactor is reduced below 530° C. but not less than 200° C. to 300° C. The temperature reduction is achieved through injection of boiling water. At these conditions the boiling water is converted to high temperature and high pressured steam which attacks the manganese oxide ($Mn_2O_3$) oxidizing it back to $MnO_2$ and liberating nascent hydrogen. The nascent hydrogen attacks the hot carbon and CO gas and helped by the catalysts hydrogenate them to hydrocarbons. As catalyst for the hydrogenations of the CO gas serves the reduced iron from the iron halide and the iron and cobalt carbonyls obtained during the above heating. The catalyst for the hydrogenation of the solid carbon serve, as previously, the chromium and the molybdenum oxides. When all hydrogen is compounded the obtained hydrocarbons are evacuated for consequent fractional distillations and the hydrogenation process as above described is repeated as many times as needed until the carbon constituent is reduced to no more than 20 percent. At that instance the chemical reactor is resupplied with new carbon or carbonaceous powder and all hydrogenation steps coninuous as above described, without the need for special hydrogen and synthesis gas plants as it is the case with the old Fischer-Tropsch process converting the synthesis gas (mixture of CO, M, N) into hydrocarbons and the Bergions process hydrogenating the coal into hydrocarbons. The thermal reduction to the $MnO_2$ to $Mn_2O_3$ at more than 530° C. liberating nascent oxygen and its hot steam oxidation back to $MnO_2$ at temperatures below 530° C. in the absence of air as above described can be used to produce alcohol instead of hydrocarbons, simply by replacing the above mentioned reduced iron and other catalyst with the classic zinc oxide based catalysts for alcohol synthesis from CO or H. The same manganese reduction oxidation process can be successfully used to produce and market pure $O_2$ and $H_2$ for any other industrial and laboratory purpose. When the above mentioned synthetic hydrocarbons are produced via my fuel alloys doped with uranium sesquicarbide $U_2C_3$ the $U_2C_3$ must be produced separately from powdered uranium mixed and alloyed with excess carbon black or other powdered pure carbons containing small amounts of halide catalysts. The necessary excess carbon must be 70 percent or more by number of atoms and the temperature range must be between 1000° C. and 1500° C. In these conditions only an amount of 7 percent to 12 percent (by weight) of the carbon reacts with the metal uranium and forms pure $U_2C_3$ alloyed partially with the same of the remaining carbons into a powdered "uranium sesquicarbide-carbon" fuel alloy which is then mixed and alloyed with the above described iron-manganese based fuel alloy. If the above synthesis conditions are not respected the yield of $U_2C_3$ is very low and can be entirely replaced by UC and $UC_2$ which while being carbides are not hydrocarbonides because they do not evolve any hydrocarbons being in fact perfectly refracting carbides only as it is the boron and many other carbides. (I coined the word hydrocarbonides namely to distinguish the hydrocarbon evolving carbides from the refractive and the other non hydrocarbon producing carbides). Because the $U_2C_3$ is expensive it is economical only when mixed up to no more than 10 percent within the fuel alloy regardless that the contained uranium is recyclicable back to $U_2C_3$ during the hydrolysis and that pure "$U_2C_3$-carbon" fuel alloy is chemically a perfect fuel alloy and can be used as basic material to build gasoline producing nuclear reactors. When the fuel alloys are produced not for immediate hydrolysis they must be doped with neutral surfactants or other neutral substances as it is the oil to prevent them from oxidation on air and moisture during the storage and transportation.

As my experience showed it the obtained engine hydrocarbons can be further improved by reforming them into high octane number cracking isothermic fuels with suitable aggregate (associate) agents "packing" them with small amounts of water or alcohols. The reason for this is the following: as it is known the best thermoydynamic process of combustion and expansion for an engine is the thermodynamic process because it cools the engine from the inside (thermodynamically) and converts the thermal energy into more mechanical work compared with any other internal combustion process. As it is known however the isothermic engine to date is only a dream because it cannot be realized by mechanical principles. I found however that the isothermic combustion and expansion can be realized with physico chemical media and processes as they are the evaporation and the condensation processes to the liquids especially to those having high latent heat of vaporization as they are water and alcohols. However direct dissolving of water into gasoline is impossible and while that is possible with some alcohol the direct dissolving of alcohols into gasoline is a nonsense because is deteriorates the ignition, do not tolerate water ans such mixture separate with the time to its original constituent through absorbing water from the humidity or through lowering the temperature during the wintertime. As I discovered the deterioration of the ignition is due both to the alcoholic OH radicals and the water molecules. Here is why I arrived at the conclusion that to use water and alcohols in order to produce isothermic fuel the water or the alcohol to both of them must not be simply dissolved into the gasoline but "packed" only inside of the gasoline through aggregate (associate particles).

Aggregate particles are well known "micelle" particles as are soaps and detergent particles however none of them is a solution to the problem because they pack the gasoline inside their cores and packs the water and the alcohols outside. As a result the ignition is worsened and become impossible because in such condition the spark is contacting pure water or alcohols the gasoline being prevented from evaporation during the ignition as occupying the central core of the micelle. The detailed analysis of the above situation showed to me that one must invent a new kind of ANTI-MICELLE aggregate particle having reversed (anti) configuration and properties permitting to "packs" the water and the alcohols "inside" of the particle (inside of its core) and the gasoline outside its outside spherical surface. It is obvious that such "liquid packing" will not affect the ignition because only the gasoline will evaporate during the ignition. Once the ignition is started the combustion process develops enough heat to evaporate the water and the alcohols to ignite the alcohols and practically realize the isothermic process., through their latent heat of evaporation. As it is known the soap micelle represents an aggregate particle composed of around 50 associate soap molecules dissolved in water. On the other hand each soap molecule is composed by one paraffinic (alkane) portion dissolving with ease all oils and other hydrocarbons and of an ionic (alkaline) portion dissolving with ease water, alcohols, and other polar liquids. In a micelle aggregate particle all alkane (paraffinic) portions of the associated soap molecules are oriented toward the center of the spherical particles thus forming its central core. Therefore the core of each micelle is a perfect solvent for all hydrocarbons. Contrary to that the outside (peripheral) surface of the spherical aggregate particle is entirely composed of the ionic portion of the soap molecules and this is why the micelle's outside surface is a perfect solvent for water and alcohols deteriorating the ignition.

I found however that using certain chemical compounds as these produced by the neutralization of the dedecyl benzene sulphonic acid and the oleic acid with isopropyl amine or with ammonia and some other compounds for they are the carboxylic esters of the alcohols open the exiting possibility to creating new aggregate particles having reverse configuration and properties to that of the micelle and permitting the packing of water and alcohols inside their cores (as they are now polar) and the gasoline outside because now the particle's outside surface is parafinic. I named the new aggregate (associate) particles ANTI-MICELLES because of their exiting Anti (reverse) configuration and properties. Using such particles I prepared various reformed (improved) engine fuels consisting of normal gasoline inside which I packed (through the above described anti-micelles) from 5 percent to 15 percent water, others on which I packed from 10 percent to 50 percent alcohols, and still others in which I packed from 10 percent to 30 percent alcohols diluted with water. They all showed perfect isothermic properties diminishing the temperature of the engine increasing the mileage per gallon by 10 to 20 percent and giving to the reformed fuels a perfect lubricating property which combined with the above mentioned cooling property promises to increase engine's life significantly. I named the above anti-micelle producing substances ANTI-SOAPS by reverse analogy with the regular soaps and to produce the above anti-micelle type "solutions" I used from 0.5 to 3 percent anti-soaps when I packed alcohols into the gasoline and up to 5 percent when I packed pure water inside of the gasoline. The above liquid type packings are not emulsions and must be classified as "Anti-micelle" type aggregate solutions because they are absolutely clear and do not show any Tyndall effect characteristic for all known emulsion type solutions. My further studies of the Anti-micelle solutions showed also that the evaporated water and the water formed during the combustion of alcohols becomes decomposed by the hot temperature of the burning (inside the engine) and helped by the catalytic properties of the anti-soap substance hydrogenate and cracks the heavier gasoline fractions into lighter hydrocarbons thus additionally increasing in situ the octane number of the combustion. On the other hand, because the anti-micelle bonding of the alcohols and the water with the gasoline within the solution is very stable for all practical purposes the anti-micelle particle is equal to alkylation and isomerization (branching) reforming of the gasoline by the alcohol molecules thus converting it to premium engine fuel.

What I claim is:

1. A process for manufacturing liquid hydrocarbons from repeatedly quenched hydrogenating fuel alloys which comprises the introducing into a reactor having a temperature of 500° C. to 1000° C. a feed stock including a powdered mixture of iron halides, oxides, and hydroxides, 50–60% powdered manganese oxides, 3 to 5% chromium and molybdenium oxides introducing air into said reactor to ignite and fluidize said mixture including sufficient carbon to produce carbon monoxide, which CO attacks said metal compounds below their melting points converting them catalytically to fuel alloys at atmospheric pressure through the evolved catalysing and self-catalyzing iron halide steam and the obtained $CO_2$ serving to increase the efficiency of the CO by reducing its partial pressure favouring faster and better yield of hydrocarbonides (liquid hydrocarbon evolving carbides) said fuel alloy being only primary one composed of different low yield manganese and iron hydrocarbonides and no hydrocarbons evolving carbides not containing cementite, the best hydrocarbonide the primary powder alloys being then passed into a cooling oil bed for repeated quenching below 50° C. to convert all of the above mentioned carbides into high yield liquid hydrocarbon evolving cementite $Fe_3C$ and manganese tritacarbide $Mn_3C$ then passing this secondary alloy composed of $Mn_3C$, $Fe_3C$, carbon unreacted chromium and molybdenium oxides and some zinc oxide into a reactor together with a hydrolyzing liquid to evolve liquid and gaseous hydrocarbons accompanied with by product hydrogen some carbonyls and reduced Iron attained at self pressure of 200 to 300 atmospheres favouring a higher percentage of the liquid hydrocarbons then increasing at the end of the hydrolysis the reactor's temperature up to 250° C. to partially react the obtained hydrogen with previously unreacted CO gas stored for that purpose in order to obtain additional Hydrocarbons then again increasing the temperature of the reactor up to 400° C. to catalytically hydrogenate the remaining Carbon constituent of the alloy into another additional yield of liquid hydrocarbons stimulated by the Cr and Mo doping then separating the obtained gasoline fraction mixing it with 0.5 to 5% anti-micelle forming agents 10 to 30 percent Methanol and 1 to 8 percent water to reform the gasoline into high grade isothermic engine fuel for which the required methanol is obtained by the same process essentially by the same kind of fuel alloy by decreasing its Cr and Mo doping and increasing its promoted zinc doping and finally recycling the Halides the hydroxides and the metal oxides obtained with the hydrolysis into the original feed stock by drying them and by mixing them with fresh carbon powder ready to be used for a new cycle of hydrocarbon synthesis.

2. The process of claim 1, having the Manganese Carbide constituent of the alloy up to 80 percent and hydrolyzing the same fuel alloy in warm or cold water.

3. The process of claim 1 which comprises subjecting the fuel alloy which includes less than 50 percent manganese carbide to acid hydrolysis at temperatures between 85° C. and the boiling temperature of the said hydrolysis liquid inside the reactor.

4. The process of claim 1 restricted to produce liquid hydrocarbons by direct self hydrogenation of the feed stock through avoiding some of its intermediary steps for which the manganese oxide constituent $MnO_2$ is up to 80% and the feed stock is heated over 530° C. but no more than 700° C. in the absence of air which pyrolitically reduces the $MnO_2$ to $Mn_2O_3$ without any chemically reducing agents as a result of which the liberated Nascent Oxigen attacks the carbon constituent of the feed stock converting it to CO gas thus self-increasing the reactor's pressure up to 100 atmospheres and more which partially reduces the iron oxides to metallic Iron catalyst concurrently accompanied with the same carbides and carbonyls after which inside the reactor a controlled quantity of boiling water is injected lowering the reactor's temperature below 530° C as a result of which the evolved steam oxidizes the $Mn_2O_3$ back to $MnO_2$ liberating Nascent Hydrogen H+ while said nascent hydrogen attacks the CO and the carbon constituent of the fluidized feed stock converting them directly to liquid hydrocarbons without quenching because the carbide constituent represents a very low percentage.

* * * * *